US005542337A

United States Patent [19]

Baumann

[11] Patent Number: 5,542,337

[45] Date of Patent: Aug. 6, 1996

[54] ELECTRO-PNEUMATIC VALVE POSITIONING DEVICE

[76] Inventor: Hans D. Baumann, 32 Pine St., Rye, N.H. 03870

[21] Appl. No.: 365,788

[22] Filed: Dec. 29, 1994

[51] Int. Cl.[6] ..... F15B 13/16

[52] U.S. Cl. ..... 91/358 R; 91/387; 91/410; 137/85

[58] Field of Search ..... 91/358 R, 387, 91/388, 389, 392, 405, 410; 137/85, 625.61; 251/29

[56] References Cited

U.S. PATENT DOCUMENTS 3,293,992 12/1966 Baumann .
3,721,422 3/1973 Bader ..... 137/85 X
4,366,670 1/1983 Kitamura ..... 137/85 X
4,585,030 4/1986 Fox ..... 137/625.61 X
4,628,793 12/1986 Roth ..... 91/387 X
4,722,360 2/1988 Odajima et al. ..... 137/85 X
4,862,788 9/1989 Baumann ..... 91/387

*Primary Examiner*—Hoang Nguyen

[57] ABSTRACT

A device capable of comparing the travel position of an output shaft of a diaphragm actuator or cylinder with the current level of an electronic input signal and further being capable of manipulating the pressure of a separate air signal piped to a diaphragm actuator or cylinder in order to correct any imbalance between such a shaft position and a given electronic signal level, including the ability of varying its dynamic response through built in adjustments.

3 Claims, 1 Drawing Sheet

ELECTRO-PNEUMATIC VALVE POSITIONING DEVICE

BACKGROUND OF THE INVENTION

This invention, an improvement over my U.S. Pat. No. 4,862,788, relates to valve positioning devices used to insure the correct position of a valve stem and the like in relationship to electronic signals originating from a separate controlling instrument which is part of process control equipment. There are numerous state-of-the-art devices that are capable of performing similar functions, for example, U.S. Pat. No. 3,293,992 describes such a device being an integral part of a piston and cylinder mechanism.

Most state-of-the-art positioning devices are rather sophisticated and complex structures, wherein the valving means are usually of a two stage amplifying variety, which makes these devices sensitive to impurities in instrument air such as water or dust.

Secondly, any two stage servo-device tends to be dynamically unstable under certain conditions.

Another drawback of present state-of-the-art devices is the fact that the mechanical interconnection between the sensed valve stem position and the spring force generated on top of a signal diaphragm (to generate feedback) is done with levers whose tilting motion is converted into rotary motion via round shafts supported by guide bushings and through other rotary to linear conversion mechanisms. All of these tend to be complex and, in addition, subject such shaft bearings to atmospheric corrosion and dirt.

My invention overcomes these difficulties by providing for a positioning device that employs only a simple one stage three-way valve to yield superior dynamic stability and employs only one stamped feedback lever without need for a separate rotary to linear conversion mechanism but instead employs two opposed pivot points, used both as support and to provide guidance for the required tilting action. Additionally, my positioning device uses a simple set screw to selectively block the exhaust flow from said three-way valve, therefore providing a simple but effective means to change not only the sensitivity but also the speed of response of my positioning device. Additionally, my invention employs a simply attached current to air pressure converter which then converts a basically pneumatic positioning device to one operated from an electrical current. Finally, as is made apparent in my description of the invention, the device is very simple, it consists of very few parts and, therefore, can be manufactured at low cost.

These and other features and advantages will be better understood from the following detailed description.

DESCRIPTION OF THE INVENTION

Figure 1:
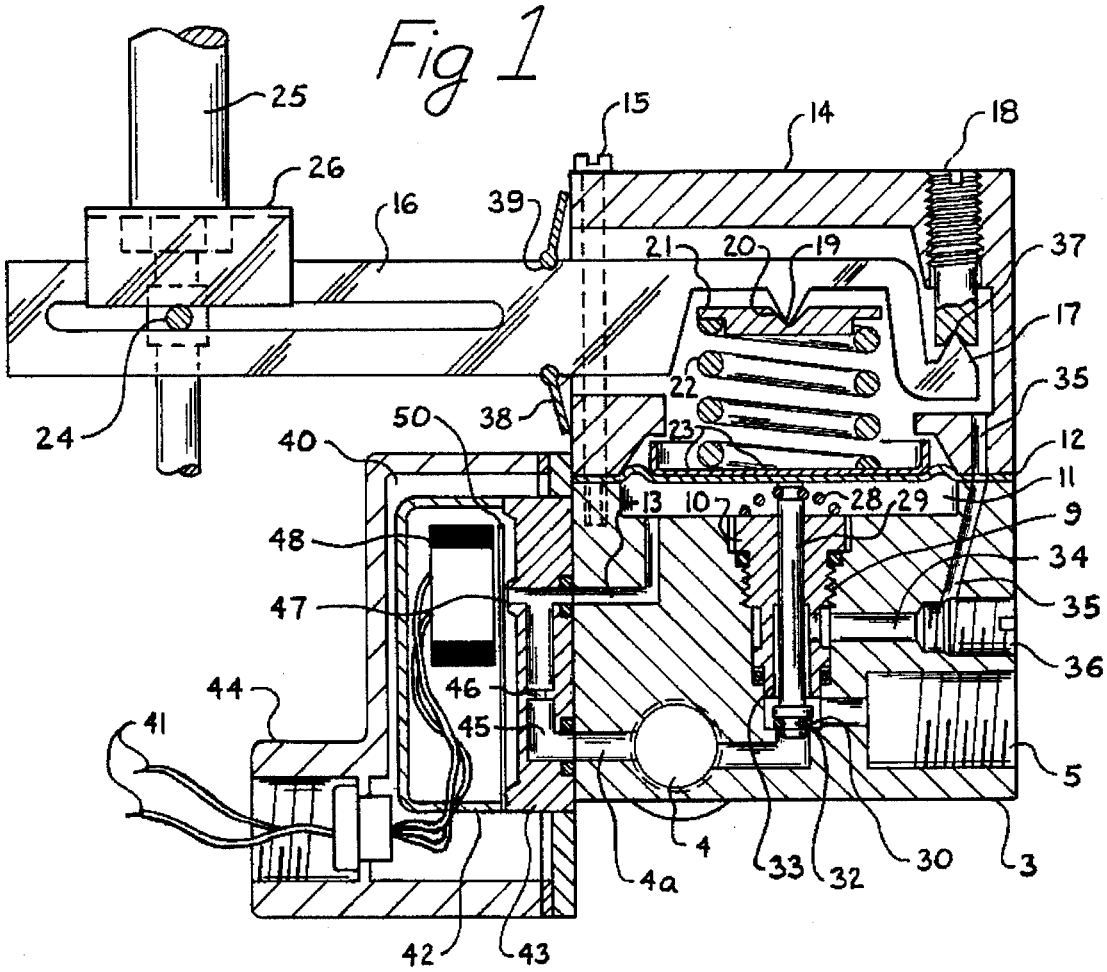
FIG. 1 is a vertical cross-sectional view of my invention.

Referring to FIG. 1, which shows my invention in a central cross-sectional view, my invention comprises a lower housing 3 having an inlet port 4 to which typically compressed air of approximately 35 psi is piped. An additional outlet port 5 normally connects, by means of a metal tubing 6, to the pressurized cavity 7 of a cylinder or diaphragm actuator 8 (not part of this invention). The lower housing 3 also has a threaded central opening 9 which contains a valve element 10 and an upper terminating part having a recessed signal chamber 11 which is closed off by a flexible diaphragm 12. A pneumatic signal from an attached electric current to air pressure converter 40 is piped to signal chamber 11 via a signal port 13. An upper housing 14, typically molded from high density plastic or cast from metal, is fastened to the top of lower housing 3 by means of screws 15.

A flat, stamped lever 16 is tiltingly engaged in upper housing 14 and having at one of its extremities a triangular shaped pivot point 17 engaging a conical recess of an adjusting screw 18 providing thereby a fulcrum point for tilting action of said lever.

Said lever 16 further has a second triangular pivot point 19 pointing in a direction opposite to pivot point 17 and engaging a conical recess 20 of a spring button 21. A compression spring 22 is located between spring button 21 and a plate 23 which supportingly engages diaphragm 12.

Lever 16 is slotted at the portion extending exterior of upper housing 14 and engages therein a pin 24. A separate valve stem 25 having an attached angular plate 26 is capable of exerting pressure on pin 24 and thereby is capable of pushing down pin 24 which in turn causes a tilting downward movement of lever 16 supported by fulcrum point 17 and a proportional downward motion of pivot point 19. It can therefore be seen that any motion of stem 25 causes a proportional change in the compressive load of spring 22 acting on top of diaphragm 12.

Figure 2:
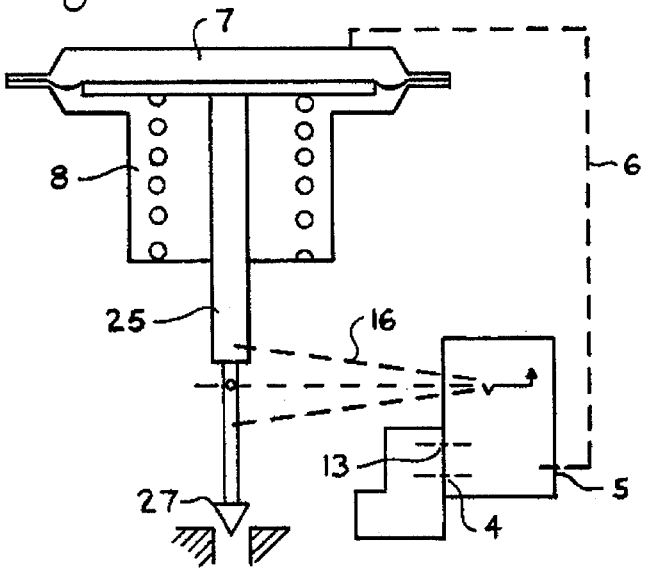
FIG. 2 is a schematic diagram showing the interaction of my invention with a valve actuating device (not part of my invention).

A control instrument, for example, that is used to control the pressure in the process piping will be sending an electronic command signal to my invention with the purpose of insuring that the travel position of valve stem 25 (FIG. 2) will correspond to this signal level and thereby result in a position of valve plug 27 that will throttle the process fluid sufficiently to reduce the process pressure to the level demanded by the process instrument. To be more specific, the electronic command signal, usually 4–20 mA is fed via wires 41 to converter 40 where it is converted into a 3–15 psi air signal via port 13 to signal chamber 11, and upon acting on diaphragm 12, exerts an upward force on plate 23. If the compressive force of spring 22 is less than this upward force created by the signal pressure, than a conical spring 28 engaging the stem 29 in valve element 10 will pull the latter up following the upward movement of diaphragm 12. This will provide an opening between sealing means 30 (usually a rubber o-ring) and the flattened seating portion 32 of inlet port 4 thereby allowing the supply air pressure from port 4 to enter and exit through port 5 into diaphragm chamber 7 of the external actuating device 8 of FIG. 2. As a result; valve stem 25 will move down, thereby exerting a downward force via pin 24 to lever 16. This causes additional compression of spring 22 until the compressive force of spring 22 is equal to the upward force generated by the signal pressure in chamber 11.

On the other hand, if the signal calls for a reduction in travel of valve stem 25, then the force acting on diaphragm 12 will decrease (caused by a reduction in signal pressure). The excess force of spring 22 will move stem 29 down thereby uncovering a recessed, enlarged bore 33 within the central portion of valve element 10. At the same time, sealing element 30 is closing off supply air from port 4. Any output air pressure from diaphragm case 7 and entering port 5 is now allowed to escape into an upper horizontal port 34 leading to a separate, near vertical vent opening 35. This way, the instrument air coming from diaphragm case 7 will purge the interior of upper case 14 and thereby prevent ambient air from causing corrosion to the working parts of my device. Following the escape of actuating air pressure through port 5 and vent 35, the spring of actuator 8 is now able to push valve stem 25 upwards causing an upward tilt of lever 16 and a reduction in spring force 22 until the system is in balance again.

An adjustment screw 36 may be used to partially restrict exhaust air flow between openings 34 and 35. This has a dual effect on the performance of the actuator/positioning device combination. First, by slowing down the exhaust flow, the rate of upward travel of valve stem 25 is greatly reduced thereby slowing down the movement of valve 27. This may be desired to accommodate certain process control dynamics. Secondly, by reducing the exhaust flow, the flow between supply port 4 and outlet port 5 is correspondingly reduced. This means sealing element 30 needs to lift off surface 32 only a small amount in order to pass this reduced flow. This reduced movement of stem 29 will require a much smaller differential between spring force 22 and the signal force acting on diaphragm 12. This in turn makes the positioning device much more sensitive and results in a substantial increase in "open loop" gain. For example, to satisfy a given exhaust flow setting of screw 36, stem 29 has to make a movement of 0.002" to pass the required air flow. Assuming further that the spring rate of spring 22 is 150 pounds per inch and the effective area of diaphragm 12 is $2in^2$, then with a 3–15 psi signal the force change on spring 22 for 100% travel would be from 6 to 30 pounds over a corresponding movement of pivot point 19 between 6/150= .040" and 30/150=0.20". That is, spring 22 undergoes a change in compression of 0.16" per 100% of signal span (12 psi). The open loop gain or amplifying factor of my device under these conditions is thereby 0.160/0.002=80:1. Should this prove to be too sensitive for a given application, then adjustment screw 36 can be unscrewed further, creating a lesser restriction between openings 34 and 35 so that it may take 0.004" for the sealing element to travel in order to pass sufficient air flow between ports 4 and 5 in order to establish equilibrium. In that case, the gain is reduced to 40:1.

In order to calibrate the device, that is to make sure that the valve element 27 reaches the shut-off position when the signal to the positioning device reaches 20 mA =15 psi, for example, adjusting screw 18 may be rotated so that the lower conical recess 37, which engages pivot point 17, allows corresponding motion of pivot point 19 and thereby alters the compression of spring 22 until the correct compression (corresponding to the desired position of valve 27) is reached. This is the "zero" adjustment of my invention. Finally, a molded elastomer seal 38 is suitably attached to lever 16, at recesses 39, in order to prevent rain from entering the opening of upper housing 14.

The I/P converting device 40 is comprised of a housing 42 and a baseplate 43, both enclosed within a suitable cover 44. Baseplate 43 has pneumatic fluid passages 45 feeding air from supply port 4 via supply passage **4*a* through a restricting orifice 46 to a nozzle 47. Electrical current flowing from wire 41 to a voice coil will activate magnet 48 and thereby change the relationship between a movable flapper 50 and the outlet flow area of nozzle 47, thereby varying the level of air pressure in that part of flow passage 45, which is downstream of restriction 46 and which is piped via signal port 13 to chamber 11**.

Having thus described what is new and what constitutes my invention, I hereby claim the following:

1. An electro-pneumatic valve positioning device comprising a) a lower housing having an inlet port, at least one outlet port, one signal port, an upper terminating portion, and a supply passage connecting to said inlet port;

b) a valve element adjustably arranged within said lower housing capable of selectively passing fluid between said inlet and said outlet ports;

c) a signal chamber located at the upper portion of said lower housing, said chamber communicating with said signal port and being closed off by a flexible diaphragm;

d) an upper housing suitably fastened to said lower housing and clamping said diaphragm therebetween;

e) lever means, a portion of which is tiltingly arranged within said upper housing and having two directionally opposed pivot points, one pivot point located at the outer extremity of said lever means, while the; second pivot point is located along the central axis of said housing;

f) at least one compression spring, a spring button located on top of said spring and capable of interacting with said second pivot point, said spring capable of exerting a force upon said diaphragm when compressed by a downward exertion of said second pivot;

g) an adjustable fulcrum point within said upper housing having a surface suitable to engage said first pivot point, and whereby an up or downward adjustment of said fulcrum point will result in a similar up or downward displacement of the second pivot point resulting in a change in the compressive force of said spring upon said diaphragm whenever the lever portion located exterior of said housing is in a fixed position;

h) a pivot pin slidingly engaged within the portion of said lever means located exterior of said housing capable of following the motion of valve stems whereby said lever means may be tilted around said first pivot point and exert a deflection proportional to said valve stem motion upon said compression spring by means of said second pivot and whereby said spring deflection in turn causes a proportional force change upon said diaphragm sufficient to balance a force created by a pressure piped to said signal port and affecting the underside of said diaphragm and whereby any imbalance between said spring force and the force of said pressure acting on the diaphragm causes a movement of said valve element which in turn is capable of varying the fluid pressure level between the inlet and outlet ports of said lower housing to affect the position of said valve stems and thereby changing the position of said lever means until the above mentioned forces are in equilibrium.

i) an electrical current to pneumatic pressure converter having at least one magnet, or any other suitable means to convert a current into mechanical force, a flapper, and a nozzle, is suitably mounted to the side of said lower housing in such a manner that it can modulate air pressure received through said supply passage from the inlet port of the lower housing and following the commands of an electronic current signal and feed such modulated air pressure back into said signal chamber via said signal port.

2. An electro-pneumatic valve positioning device as described in claim 1, wherein said valve element comprises a spool piece having a central bore whose lower portion is slightly enlarged and a stem slidingly engaged in said central bore and having a head portion encompassing an upper and lower sealing surface, wherein said stem is capable of closing off said inlet port when in the lowest position and capable of closing off the slightly enlarged bore when in the upper position, an exhaust port located within said lower housing and extending sideways through the wall of said spool piece into the slightly enlarged bore of said spool piece.

3. An electro-pneumatic valve positioning device as described in claim 2, wherein said exhaust port terminates in a threaded portion and having a further vent bore extending upwardly into said upper housing, an adjustment screw arranged within said threaded portion of the exhaust port to cover or uncover said vent bore thereby more or less restricting the flow passing said exhaust port.

* * * * *